United States Patent [19]

Foote et al.

[11] 3,938,444

[45] Feb. 17, 1976

[54] FLARE CARTRIDGE

[75] Inventors: Kenneth R. Foote; Michael Mamula, both of China Lake, Calif.

[73] Assignee: The United States of America as represented by the Secretary of the Navy, Washington, D.C.

[22] Filed: July 5, 1974

[21] Appl. No.: 486,922

[52] U.S. Cl. ..... 102/99; 102/35; 102/37.8; 264/3 R

[51] Int. Cl.[2] ..... F42B 4/26

[58] Field of Search ..... 102/37.8, 35, 35.6, 37.6, 102/32, 99; 264/3 R

*Primary Examiner*—Charles T. Jordan

*Attorney, Agent, or Firm*—R. S. Sciascia; Roy Miller; Gerald F. Baker

[57] ABSTRACT

An improved IR decoy flare is provided which can be reliably fired from a pyrotechnic pistol. Reliability of ignition is provided simply and easily by inserting a cutting tool into the end of a star bore flare grain for a short distance to produce curled shavings from the inner surface of the grain.

7 Claims, 3 Drawing Figures

FLARE CARTRIDGE

CROSS REFERENCE TO RELATED APPLICATIONS

The present invention relates to cartridge type flares such as disclosed in Assignee's Co-pending application Ser. No. 766,039 filed Oct. 4, 1968.

A similar flare cartridge is also disclosed in Assignee's Prior Application Ser. No. 289,201 filed Sept. 14, 1972, now U.S. Pat. No. 3,782,285.

BACKGROUND OF THE INVENTION

The present invention relates to flares and particularly to cartridge type flares.

More particularly the present invention is concerned with cartridge type flares which are constructed for high infra-red (IR) output.

The present invention was developed particularly for use with a bore-safe flare cartridge as disclosed in Assignee's Prior Applications listed above. In such a bore-safe flare, the flare grain is not ignited until it has cleared the muzzle of the launching device. It is desirable, however, that the flare be ignited as soon as possible after leaving the muzzle of the device and that it be ignited with a high degree of reliability.

According to the present invention, a hollow cylindrical cutting tool is forced into the end of the hollow flare grain for a short distance producing curled shavings. Obviously these shavings are more easily ignited than the solid end of the flare grain. By this simple technique it has been found that these decoy flares may be reliably fired from a pyrotechnic pistol or the like using a flare cartridge according to the bore-safe designs described above.

DESCRIPTION AND OPERATION

Figure 1:
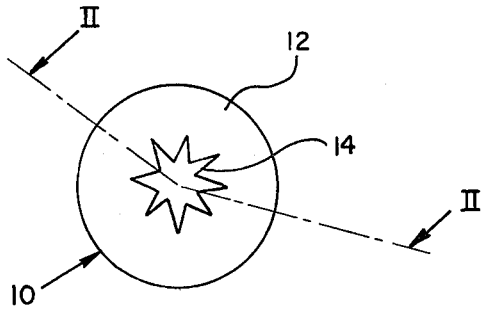
FIG. 1 is an end view of a flare grain usable in the present invention.

Flare grains used in pyrotechnic applications are typically configured as indicated generally by the numeral 10 in FIG. 1. The flare grain 10 which is pressed or extruded or otherwise manufactured from a pyrotechnic formulation 12, may have a bore 14 in the form of a star or other convoluted configured similar to the 8 point star as shown.

Figure 2:
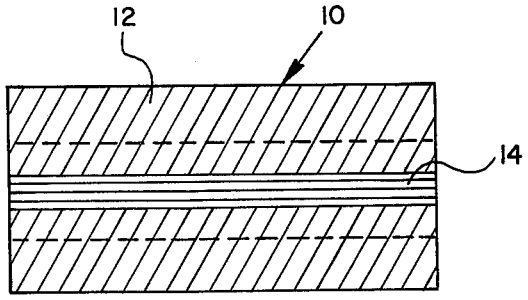
FIG. 2 is a longitudinal cross sectional view of the flare grain taken along line II—II of FIG. 1.

The central bore may be straight or tapered depending upon the mode of manufacture but generally the pattern is fairly regular as shown in FIG. 2.

Figure 3:
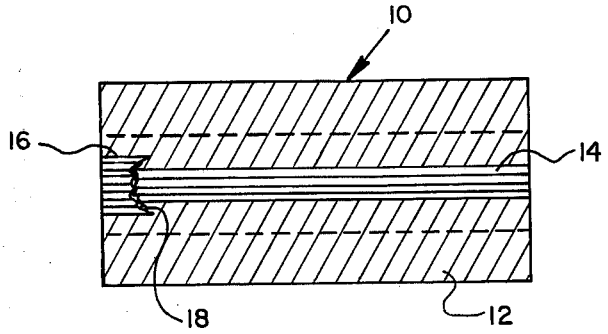
FIG. 3 is a view similar to FIG. 2 of a flare grain which has been cut by a cylindrical shaving tool.

The flare grains used in this application are designed for internal ignition and it has been found that reliable ignition may be greatly enhanced by introducing a cutting tool such as a cylindrical knife into the end of the flare grain along the line 16 as shown in FIG. 3 to produce curled shavings 18. Where the bore of the grain is convoluted or alternate lands and grooves, the cutting tool is used to cut the lands away from the surface for a short way to produce the desired shavings. These shavings 18 catch fire much quicker than the smooth surface of the grain as manufactured and this greatly increases the reliability of ignition of the flare.

Simply because a flare grain composition when ignited burns rapidly and gives off a desirable quantity of infra-red radiation does not mean that the composition necessarily ignites easily. Furthermore, it is highly desirable from a standpoint of safety in manufacture, shipping and storage, for example, to have a flare grain which does not ignite too easily. Where the flare cartridge is small, however, and the time for ignition is short a tradeoff of materials must be made to accomplish reliable ignition in the space and time afforded.

With the present invention, the range of materials usable in these flare devices is increased because of the reliable ignition of the curled shavings in the bore at the point of ignition.

Where the flare is to be used as a decoy for IR homing missiles, for example, the time span from initiation of ignition up to maximum infra-red output must be extremely short in order for the maximum radiation to be available while the flare is still in the field of view of the missile seeker.

From the forgoing it may be seen that a novel flare grain has been provided which is easily and reliably ignited in a short period of time and is highly suitable for use in a bore-safe cartridge flare for an IR decoy.

What is claimed is:

1. The method of producing a flare grain of greater ignition reliability comprising the steps of:

forming a pyrotechnic mix into a hollow cylindrical segment with a longitudinal bore;

cutting into one end of said segment along said bore to form curled shavings which remain attached to the surface of said bore.

2. The method of claim 1 wherein said pyrotechinc mix is formed into a cylindrical segment having a convoluted bore.

3. The method of claim 1 wherein said bore is formed with alternate lands and grooves and the lands are cut in one end of said bore to form said curled shavings.

4. A flare grain comprising:

a hollow segment of pyrotechnic material having a longitudinal bore;

a partial counter bore in one end of said segment; and a plurality of cut curled protuberences in said counter bore.

5. The flare grain of claim 4 wherein said segment of pyrotechnic material is cylindrical.

6. The flare grain of claim 4 wherein said bore is convoluted.

7. The flare grain of claim 4 wherein said flare grain is cylindrical, said bore is formed with alternate lands and grooves and the lands are cut in one end of said bore to form curled shavings remaining adhered to the inner surface of said bore.

* * * * *